US006605765B1

(12) United States Patent
Johnson

(10) Patent No.: US 6,605,765 B1
(45) Date of Patent: Aug. 12, 2003

(54) ACOUSTIC GUITAR WITH INTERNALLY LOCATED CASSETTE TAPE PLAYER

(76) Inventor: William A. Johnson, 1308 Cullman Rd., Arab, AL (US) 35016

( * ) Notice: Subject to any disclaimer, the term of this patent is extended or adjusted under 35 U.S.C. 154(b) by 0 days.

(21) Appl. No.: 10/051,525

(22) Filed: Jan. 18, 2002

Related U.S. Application Data

(60) Provisional application No. 60/262,958, filed on Jan. 19, 2001.

(51) Int. Cl.[7] ..... G10D 1/08
(52) U.S. Cl. ..... 84/267
(58) Field of Search ..... 84/267, 291, 723, 84/461, 462

(56) References Cited

U.S. PATENT DOCUMENTS 4,748,887 A * 6/1988 Marshall ..... 84/646
5,136,918 A * 8/1992 Riboloff ..... 84/723
5,889,221 A * 3/1999 Dejima ..... 84/291
6,291,755 B1 * 9/2001 Hine et al. ..... 84/454

* cited by examiner

*Primary Examiner*—Shih-Yung Hsieh
(74) *Attorney, Agent, or Firm*—Joseph H. Beumer

(57) ABSTRACT

An acoustic guitar is combined with a cassette tape player carried inside of the body of the guitar and arranged for playing recorded music simultaneously with live music being played on the guitar by a musician. Necessary switches, wiring, and power supplies are also included. In one version of the assembly all components are carried inside or on the surface of the guitar so as to provide a self-contained assembly. Another version includes an external, large amplifier/speaker located away from the guitar but interconnected with controls and a pickup device on the guitar.

8 Claims, 4 Drawing Sheets

ACOUSTIC GUITAR WITH INTERNALLY LOCATED CASSETTE TAPE PLAYER

CROSS REFERENCE TO RELATED APPLICATION

This application claims the benefit of applicant's provisional application Ser. No. 60/262,958, filed Jan. 19, 2001.

FIELD OF THE INVENTION

This invention relates to musical instruments and more particularly to hollow string instruments equipped with devices for playing previously recorded music.

BACKGROUND OF THE INVENTION

Various applications exist for musical instruments combined and integrated with devices such as cassette tape players which can play previously recorded music. For training purposes, a student playing the musical instrument could learn timing as well as other aspects of performing a musical piece by following the lead of a cassette recording being played simultaneously. The cassette recording also might provide background music or accompaniment for a performer. A musician/song writer could record his or her music for a new song on a tape cassette and play and/or sing along with the recording.

Systems which enable playing of live music on an instrument simultaneously with reproducing sounds of recorded music at the same instrument lend themselves to use by a performer who wishes to create an initial impression that the sounds being heard are coming only from the live music source. This requires that necessary components for operation of the recorded music player device be placed inside of the instrument where possible as may be done to a large extent for hollow string instruments such as acoustic guitars. The cassette components should be placed so as not to unduly interfere with playing the guitar or to adversely affect the quality of live music sounds. Furthermore, controls for operation of the device should be readily accessible on the body of the guitar so that switching operation will not be noticeable or distracting to any audience. Another desirable feature for a self-contained acoustic guitar/cassette tape playing system would be compatibility with certain external components such as an external amplifier/speaker located away from the guitar. In such case, controls for the external component should be carried on an outer surface of the guitar at an easily accessible location. Use of an external amplifier/speaker would enable greater volume as may be required outdoors or in auditoriums and large rooms.

SUMMARY OF THE INVENTION

The present invention is directed to a musical assembly comprising a hollow string instrument, in particular an acoustic guitar, combined with a device such as a cassette tape player carried inside the body of the instrument, with the cassette tape player being adapted for playing prerecorded music simultaneous with live music being produced on the instrument by a performer. The cassette tape player may be supported inside the guitar body by a receptacle provided at an edge rim of the guitar body and positioned such that the cassette extends below the surface of the rim. Other components of the assembly, as would be required for a complete operating system, include speakers located inside the body and having their forward ends secured around apertures provided in a front panel of the body, a power supply, an electrical switch, connecting wires and supporting structure for securing all components to the body of the instrument. Components added to and combined with the guitar may be located within or at the surface of the guitar so as to avoid use of external, remote components in a self-contained embodiment.

While the assembly of this invention may be provided in an entirely self-contained form, that is, without any connections to external power sources, additional speakers or the like, it is compatible with such further enhancements when desired in certain situations. In particular a capability for higher volume may be needed for performing outdoors or in auditoriums and large rooms. External components such as large amplifiers/speakers powered by a remote 110V AC power system may be connected to control switches on the guitar and wired to receive signals from the cassette player or from a pickup device installed on the guitar. This measure enables a greater volume of sound from the live music source to be produced in comparision to the volume of sound from the recorded source. Flexibility in blending sounds from each source with one another is also enabled.

It is accordingly an object of this invention to provide a musical entertainment assembly including a hollow string instrument and a device for playing recorded music located inside the body of the instrument.

Another object is to provide a combined assembly of an acoustic guitar and a means for playing recorded music simultaneously with playing of the guitar.

Yet another object is to provide a means for operably connecting a remote speaker/amplifier to an acoustic guitar whereby the speaker/amplifier may be integrated with operation of a cassette player carried by the guitar.

Other objects and advantages of the invention will be apparent from the following detailed description and the appended claims.

BRIEF DESCRIPTION OF THE DRAWINGS

FIG. 5 is a diagrammatic view showing interconnections of components of the assembly of the invention.

DESCRIPTION OF THE PREFERRED EMBODIMENT

Figure 1:
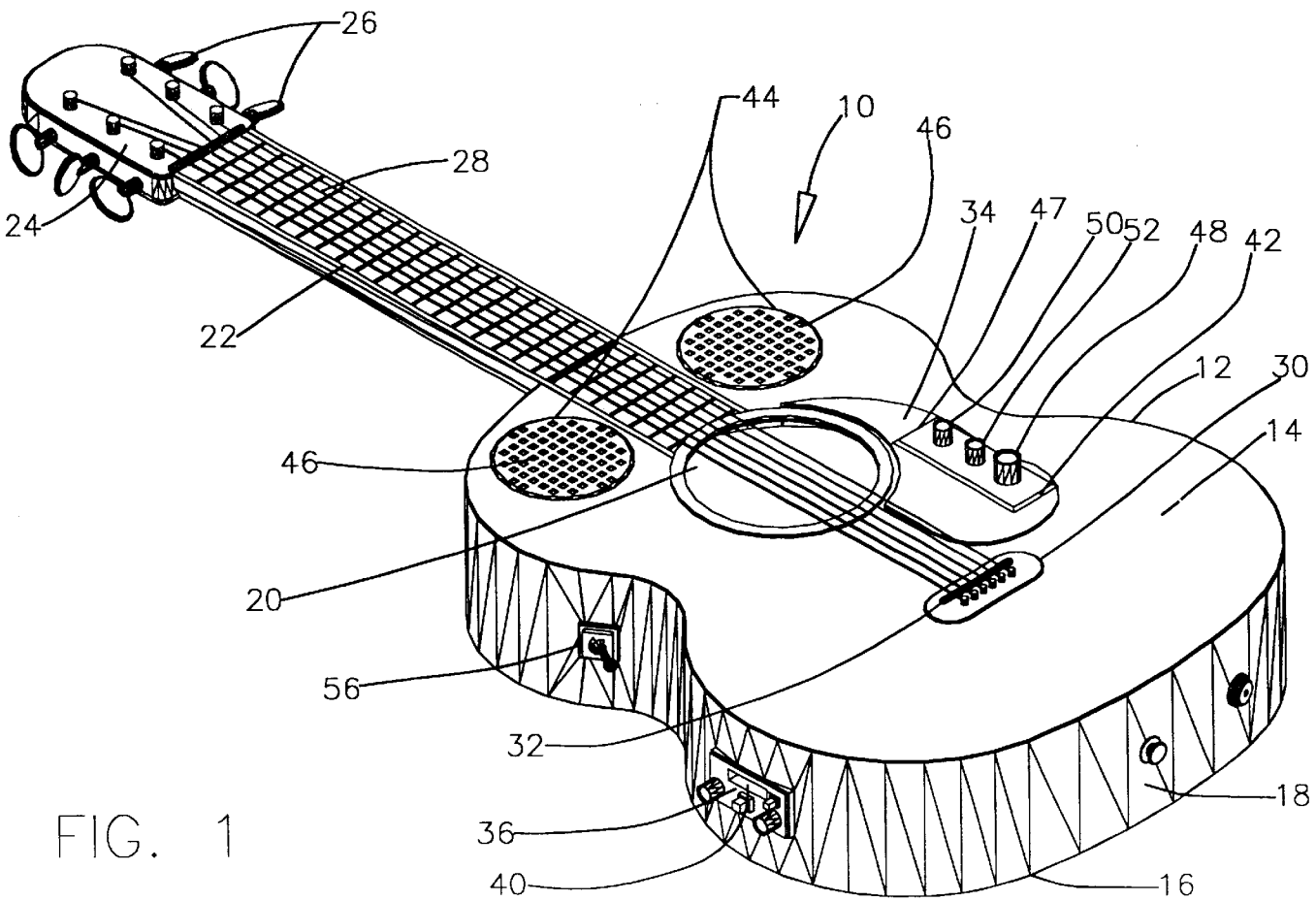
FIG. 1 is a perspective view of an acoustic guitar/cassette tape player assembly embodying the invention, this view showing only those components visible from outside the guitar.

Referring to FIG. 1 of the drawings, there is shown an acoustic guitar 10 having a hollow body 12 made up of a front panel 14, a back panel 16 and an edge rim 18 connecting the panels and extending around the periphery of the body. The acoustic guitar has conventional features including an acoustic opening, or "sound hole" 20 extending through front panel 14, a neck 22 disposed outward longitudinally from the sound hole, a head stock 24 at the outward end of the neck, adjustment pegs 26 carried by the head stock and holding strings 28 anchored in a saddle 30 over a sound bridge 32. The guitar body also has a protective scratch pad 34 disposed adjacent the sound hole and aligned to be contacted by fingers of a user.

Figure 2:
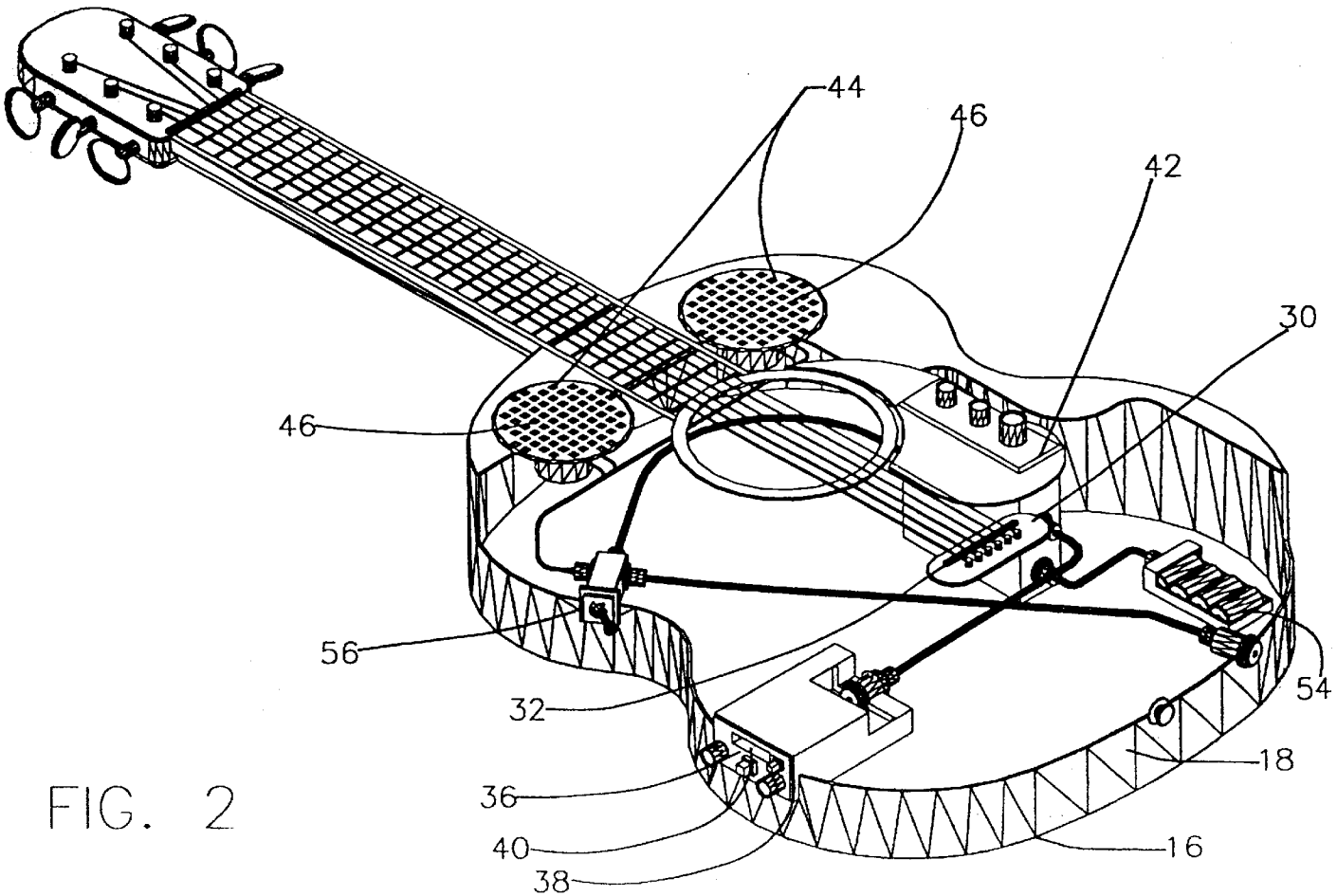
FIG. 2 is a view with the front panel of the guitar broken away, showing components located inside the guitar body.

A cassette tape player 36 (FIG. 2) is carried by the guitar body, and may be supported by a receptacle 38 connected to an upper side of edge rim 18, with the receptacle available for removable insertion of cassette tapes through a slot 40 provided in the edge rim. Output from the cassette tape player may be passed to an amplifier 42 carried by front panel 14 and from there to a pair of stereo speakers 44, also carried by the front panel at openings 46 therein. Speakers 44 and amplifier 42 may be provided as a matching set of a type and size normally used in personal computer systems. A control panel 47 located at scratch pad 34 has an adjustment knob 48 for volume control and knobs 50, 52 for turning power off and on and for bass adjustment, respectively. Amplifier 42 is also connected to a power supply which may be provided in the form of four 1.5 volt batteries 54 carried in case 55.

A switch 56 is located conveniently at an upper side location on edge rim 18, enabling power to the speakers to be turned off and on.

Figure 3:
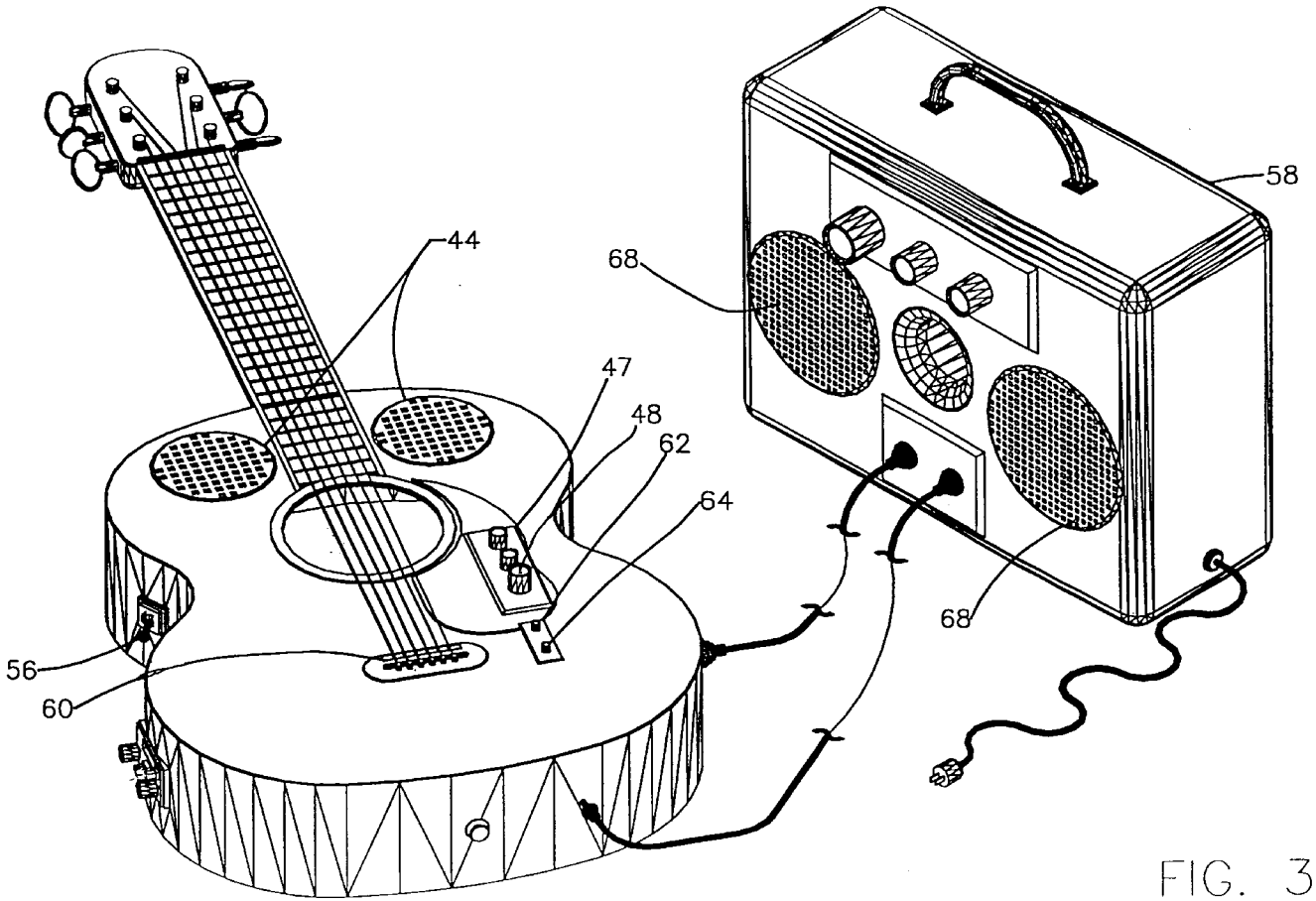
FIG. 3 is a view as in FIG. 1 and showing additional components coupled to an external speaker/amplifier.
Figure 4:
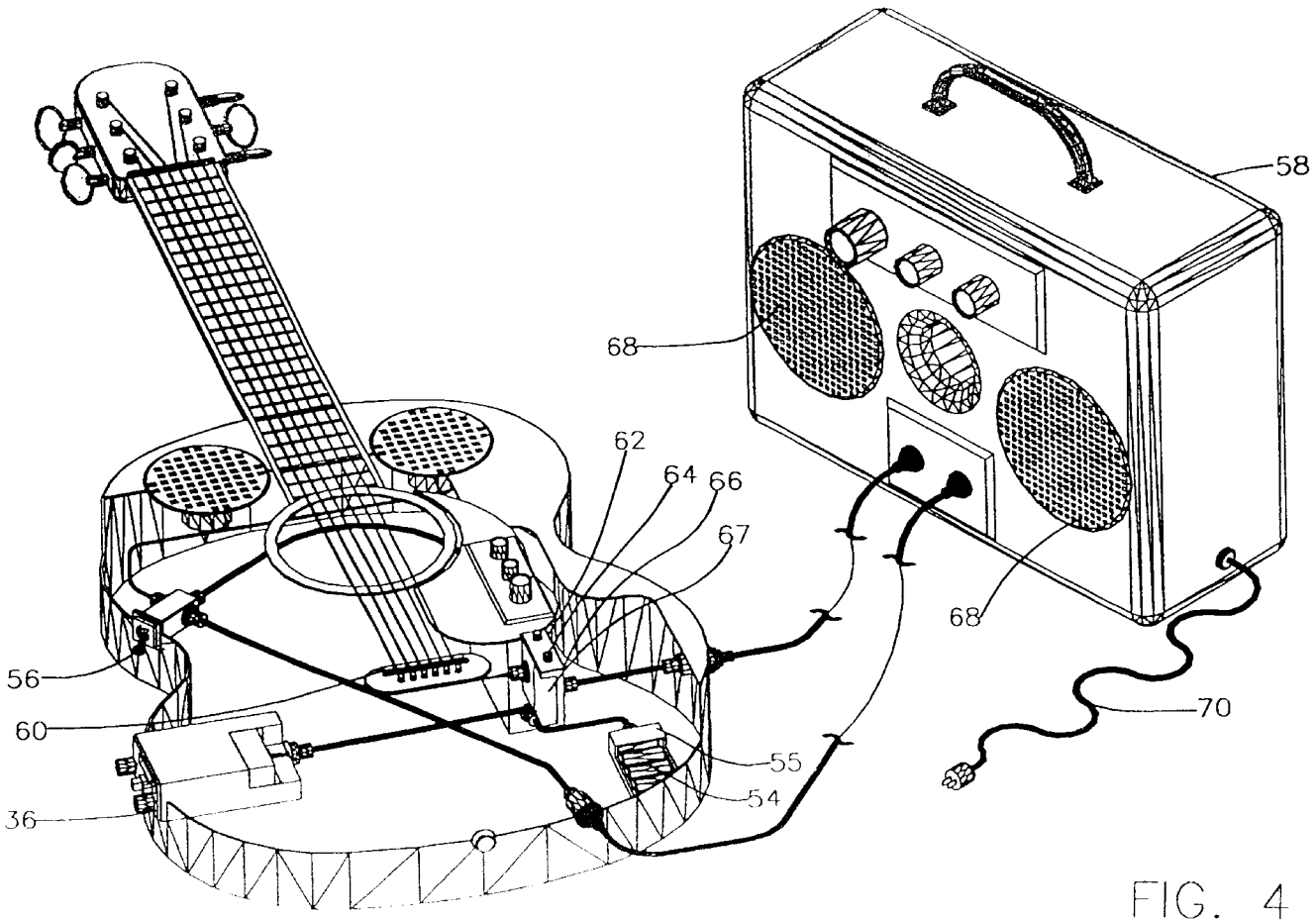
FIG. 4 is a view as in FIG. 2 and with the side edge rim of the guitar partially broken away, showing internal components for the embodimednt of FIG. 3.

FIG. 3 shows the embodiment of FIG. 1, further modified to include an additional large amplifier/speaker device 58 having a pair of speakers 68 located external to the guitar body but interconnected with controls and other components within or on an external surface of the body. In order to obtain more effective transmission of sounds produced by strings in live playing, a pickup 60 may be placed under the bridge 32, the pickup being connected to the external amplifier/speaker through a control panel 62 having a volume control 64. The pickup is also connected to a power supply 67 in the form of a 9 volt battery carried in case 66.

Amplifier/speaker 58 may be powered by a 110 volt AC line as is commonly available through cord 70. In order to allow versatile use of the amplifier/speaker for enhancement of either the cassette output or alternatively, the output from the pickup obtained from live playing, the amplifier/speaker may be connected to each of these sources and wired through toggle switch 56 modified to enable a selection of the desired sound source.

Necessary components provided within or on an outer surface of the guitar may be secured by cutting holes in panels or edge rims of the body, sized to obtain a snug fit of the added component in contact with the panel or rim or with a leather lining on a receptacle. Adhesive bonding may also be used.

Commercially available components may be employed in the assembly of this invention. A suitable large amplifier/speaker for external use is available from Fender Company under the designation "Revert 35," 110–120 volts AC, 50–60 Hz and 90 watt capacity. Internal speakers 44 and amplifier 42 may be provided in the form of a matched combination of a pair of stereo speakers and an amplifier of a type commonly used in personal computer systems, available from Radio Shack company. Co-axial cables with conventional jacks and receptacles for making connections may be used for interconnecting the various components.

While the invention is described above in terms of a cassette tape player, it is to be understood that other forms or devices for playing recorded music such as CDs or other disks playable on cassettes may also be used. Also, the hollow string instrument component may comprise instruments other than guitars, in particular, banjos, dobros, violins and mandolins.

What is claimed is:

1. A music assembly for obtaining pre-recorded musical sounds simultaneously with live music comprising, in combination;

an acoustic guitar having a hollow body made up of a front panel, a rear panel and a side rim connecting said panels, said front panel having defined therein an acoustic opening and carrying strings extending over said opening;

a cassette player removably supported inside of said body and adapted for playing previously recorded music, said cassette internally mounted in a receptacle connected to an upper side portion of said side rim;

speaker means coupled to said cassette player and located within said body and extending through openings defined in said front panel;

amplifier means coupled to said speaker means;

power supply means connected to said amplifier and said speaker means; and switch means coupled to said cassette player.

2. The assembly as defined in claim 1 wherein said cassette is a tape player.

3. The assembly as defined in claim 2 further including a control panel electronically coupled to said speaker means and located on an outer surface of said front panel.

4. The assembly as defined in claim 3 wherein said speaker means comprises a pair of speakers disposed in openings defined in said front panel adjacent a narrow end thereof.

5. The assembly as defined in claim 6 wherein said switch means comprises a toggle switch located adjacent said receptacle on said upper side portion of said side rim.

6. A music assembly comprising, in combination;

an acoustic guitar having a hollow body up of a front panel, a rear panel and a side rim connecting said panels, said front panel having defined therein an acoustic opening and carrying strings extending over said opening;

a cassette player removably supported inside of said body and adapted for playing previously recorded music, said cassette player internally mounted in a receptacle connected to an upper side portion of said side rim;

internal speaker means coupled to said cassette player and located within said body and extending through openings defined in said front panel;

internal amplifier means coupled to said internal speaker means;

power supply means connected to said internal amplifier and said internal speaker means;

switch means coupled to said cassette player;

an external amplifier/speaker located outside of said body and adapted to selectively and alternatively receive an output from said cassette player or from strings of said guitar and to produce an enhanced sound from a said output.

7. The assembly as defined in claim 6 further comprising a pickup coupled to said strings and connected to said external amplifier and said external speaker.

8. The assembly as defined in claim 7 wherein said external speaker and said external amplifier are adapted to operate on power obtained from a 110 volt AC line.

* * * * *